US010145641B2

(12) United States Patent
Hout

(10) Patent No.: US 10,145,641 B2
(45) Date of Patent: Dec. 4, 2018

(54) CROSSBOW PIVOTING CABLE SAVER

(71) Applicant: Hunter's Manufacturing Company, Inc., Suffield, OH (US)

(72) Inventor: Jacob A. Hout, Akron, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 15/899,782

(22) Filed: Feb. 20, 2018

(65) Prior Publication Data

US 2018/0238655 A1 Aug. 23, 2018

Related U.S. Application Data

(60) Provisional application No. 62/461,409, filed on Feb. 21, 2017.

(51) Int. Cl.
*F41B 5/12* (2006.01)

(52) U.S. Cl.
CPC ..... *F41B 5/12* (2013.01); *F41B 5/123* (2013.01)

(58) Field of Classification Search
CPC ..... F41B 5/10; F41B 5/12; F41B 5/123
See application file for complete search history.

(56) References Cited

U.S. PATENT DOCUMENTS

| | | | |
|---|---|---|---|
| 2,650,948 | A | 9/1953 | Findlay |
| 3,483,857 | A | 12/1969 | Jones |
| 3,486,495 | A | 12/1969 | Allen |
| 4,060,066 | A | 11/1977 | Kudlacek |
| 4,716,880 | A | 1/1988 | Adkins |
| 4,827,893 | A | 5/1989 | Nishioka |
| 4,947,822 | A | 8/1990 | Jones |
| 5,062,406 | A | 11/1991 | Robertson |
| 5,119,797 | A | 6/1992 | Anderson |
| 5,362,046 | A | 11/1994 | Sims |
| 5,437,260 | A | 3/1995 | King |
| 5,553,596 | A | 9/1996 | Bednar |
| 8,991,375 | B2 | 3/2015 | Mcpherson |
| 9,200,863 | B2 | 12/2015 | Bednar |
| 9,255,758 | B1 | 2/2016 | Bednar et al. |
| 9,285,182 | B2 | 3/2016 | Bednar et al. |
| 9,335,115 | B2 | 5/2016 | Bednar et al. |
| 9,410,765 | B2 | 8/2016 | Bednar et al. |

*Primary Examiner* — John Ricci
(74) *Attorney, Agent, or Firm* — Emerson Thomson Bennett LLC

(57) ABSTRACT

A crossbow cable saver may have a cable engagement portion designed to engage at least one crossbow cable and a main beam engagement portion designed to engage the crossbow main beam. The cable saver may be operable to pivot with respect to the main beam between a first position where a first surface of the main beam engagement portion contacts the main beam and the second surface does not; and a second position where the second surface contacts the main beam and the first surface does not.

20 Claims, 15 Drawing Sheets

CROSSBOW PIVOTING CABLE SAVER

This application claims priority to U.S. Provisional Patent Application No. 62/461,409 filed Feb. 21, 2017, entitled CROSSBOW PIVOTING CABLE SAVER, which is incorporated herein by reference.

I. BACKGROUND

A. Field of the Invention

This invention generally relates to methods and apparatuses related to crossbows and more specifically to methods and apparatuses related to cable savers used to support cables to a crossbow main beam slot.

B. Description of Related Art

Crossbows have been used for many years as a weapon for hunting and fishing, and for target shooting. In general, a crossbow has a main beam that may include a stock member and a barrel connected to the stock member. The main beam typically has an arrow receiving area for receiving the arrow that is to be fired or shot. The crossbow also includes a bow assembly supported on the main beam that includes a bow (including a pair of bow limbs) and a bowstring connected to the bow for use in shooting arrows. A trigger mechanism, also supported on the main beam, holds the bowstring in a drawn or cocked condition and can thereafter be operated to release the bowstring out of the uncocked condition to fire or shoot the arrow.

Often known crossbow bow assemblies include one or more cables, many times associated with cams and/or pulleys and/or wheels, which are attached to the bow assembly. Typically the cable(s) extend from one bow limb to the other bow limb. The cable(s) usually pass by or through the main beam via a main beam slot (also known as a barrel slot or a cable slot), which allows the cable(s) to move freely during draw (cocking) and release (firing) operations. However, due to crossing of the cables and/or the disposition of the cables in the main beam slot, there is a likelihood that the cables can rub against each other, and/or against the edges of the main beam slot. This may lead to unwanted noise and premature cable wear. To reduce these problems, it is known to provide cable savers that support the cables to or within the main beam slot. Cable savers typically have one or more openings or slots that engage the cable(s) and a groove that is designed to engage a surface of the main beam near the main beam slot. FIG. 3 shows a known arrangement where a pair of cables 300, 300 are engaged with a cable saver 302 that is engaged with a main beam slot 304. The main beam slot 304 is formed in a main beam 316 that has a longitudinal axis 318 that extends along the length of the main beam 316. The cable saver 302 has a bottom 314 with a pair of openings 306, 306 that engage the cables 300, 300 and a top 312 with a groove 308 that engages the main beam 316. In this specific example, the groove 308 engages the main beam rail 310. FIG. 4 shows a cable saver 400 similar to the cable saver 302 shown in FIG. 3. The groove 402 that engages a crossbow main beam has a substantially uniform depth 404. While known cable savers, including cable saver 302 shown in FIG. 3 and cable saver 400 shown in FIG. 4, generally work well for their intended purposes, they are known to have problems. One known problem is that the surface of the cable saver that engages the main beam, such as the portions of the cable savers 302/400 defining grooves 308, 402, may adhere or stick to the main beam that they engage. Another known problem is that unwanted noises are created by the contact between the cable saver and the crossbow when the crossbow is cocked and fired. These problem can sometimes be mitigated by inserting lubrication into the cable saver grove. The lubricant used, however, must be of the appropriate type and must be frequently added. As a result, the use of lubrication adds unwanted time, effort and cost for the crossbow user. Also, lubrication at best only diminishes a portion of the unwanted sticking and noise.

What is needed is a cable saver that mitigates the problems noted above, and others, without the need for lubrication or any other "add on" material or device.

II. SUMMARY

According to some embodiments of this invention, a crossbow cable saver may be used with an associated crossbow having: 1) a bow including: (a) a bowstring; and, (b) one or more cables; and, 2) a main beam having a main beam slot. The crossbow cable saver may comprise: a cable engagement portion designed to engage at least one of the one or more cables; and, a main beam engagement portion designed to engage the main beam and comprising: a first surface, a second surface, and a pivot surface that is positioned between the first and second surfaces and that defines a pivot axis. The cable saver may be operable, when properly positioned within the main beam slot, to pivot about the pivot axis with respect to the main beam between: 1) a first position where the first surface contacts the main beam and the second surface does not contact the main beam; and 2) a second position where the second surface contacts the main beam and the first surface does not contact the main beam.

According to some embodiments of this invention, a method for a crossbow cable saver used with an associated crossbow having: 1) a bow including: (a) a bowstring; and, (b) one or more cables; and, 2) a main beam having a main beam slot may comprise the steps of: (A) providing a crossbow cable saver comprising: a cable engagement portion designed to engage at least one of the one or more cables; and, a main beam engagement portion designed to engage the main beam and comprising: a first surface, a second surface, and a pivot surface that is positioned between the first and second surfaces and that defines a pivot axis; and (B) providing the cable saver to be operable, when properly positioned within the main beam slot, to pivot about the pivot axis with respect to the main beam between: 1) a first position where the first surface contacts the main beam and the second surface does not contact the main beam; and 2) a second position where the second surface contacts the main beam and the first surface does not contact the main beam.

According to some embodiments of this invention, a crossbow cable saver may be used with an associated crossbow having: 1) a bow including: (a) a bowstring; and, (b) one or more cables; and, 2) a main beam having a main beam slot. The crossbow cable saver may comprise: a cable engagement portion designed to engage at least one of the one or more cables; and, a main beam engagement portion designed to engage the main beam and comprising: a pivot surface that that defines a pivot axis. The cable saver may be operable, when properly positioned within the main beam slot, to pivot about the pivot axis at least 5 degrees with respect to the main beam in response to a force exerted on the cable saver by the at least one of the one or more cables.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

III. DEFINITIONS

The following definitions are controlling for the disclosed inventions:

"Arrow" means a projectile that is shot with (or fired by or launched by) a bow assembly.

"Bow" means a bent, curved, or arched object. A bow includes a pair of bow limbs.

"Bow Assembly" means a weapon comprising a bow and a bowstring that shoots (or fires or propels) arrows powered by the elasticity of the bow and the drawn bowstring.

Figure 3:
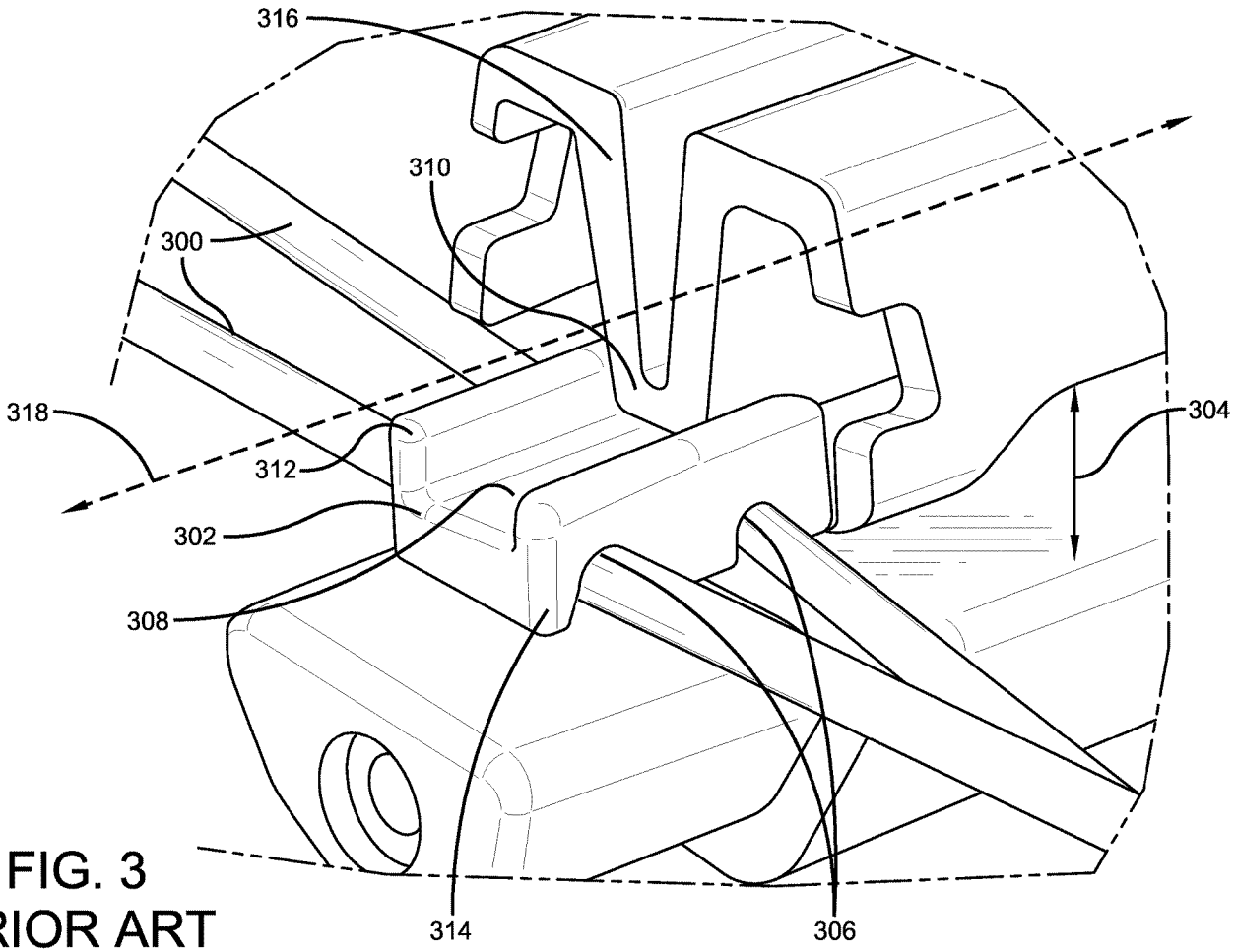
FIG. 3 PRIOR ART
FIG. 3 is close-up view of a prior art cable saver with a crossbow.
Figure 4:
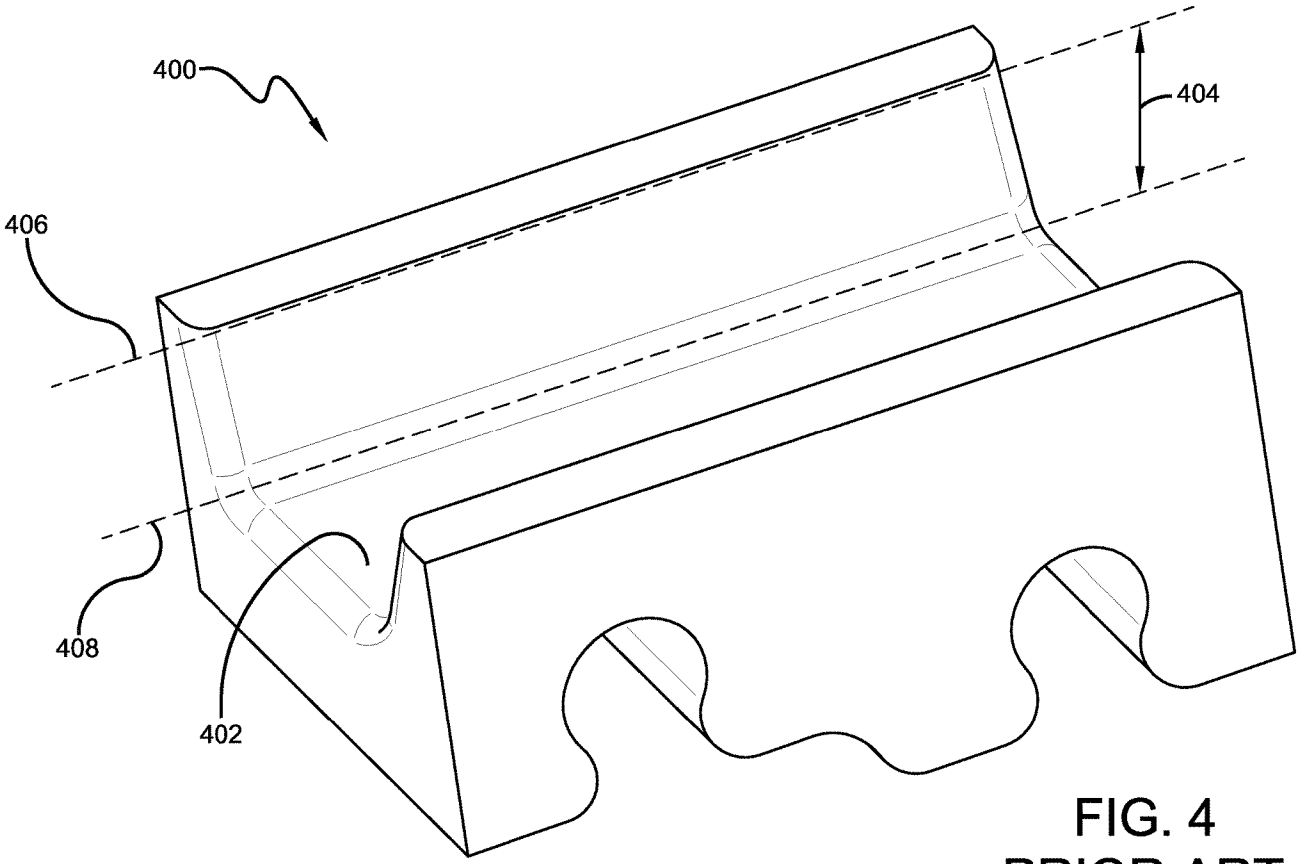
FIG. 4 PRIOR ART
FIG. 4 is a perspective view of a prior art cable saver.

"Bottom" means, when related to a crossbow, the lowest or down most part of something when the crossbow is in the standard use position. Thus, for examples, reference 214 in FIG. 2 refers to the bottom of barrel 204, reference 314 in FIG. 3 refers to the bottom of cable saver 302, and reference 408 in FIG. 4 refers to the bottom of groove 402.

"Bowstring" means a string or cable attached to a bow and used to shoot (or fire or propel) arrows.

"Compound Bow" means a bow that has wheels, pulleys or cams at each end of the bow through which the bowstring passes. A compound bow may include strings or cables in addition to the bowstring that interconnect the wheels, pulleys or cams to each other and/or to other portions of the bow.

"Crossbow" means a weapon comprising a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. A main beam may include a stock member and a barrel. Sometimes a barrel is a distinct component from the stock member that is attached to the stock member. Other times the barrel and stock member comprise a single component.

"Top" means, when related to a crossbow, the highest or uppermost part of something when the crossbow is in the standard use position. Thus, for examples, reference 212 in FIG. 2 refers to the top of barrel 204, reference 312 in FIG. 3 refers to the top of cable saver 302, and reference 406 in FIG. 4 refers to the top of groove 402.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

IV. DETAILED DESCRIPTION

Figure 1:
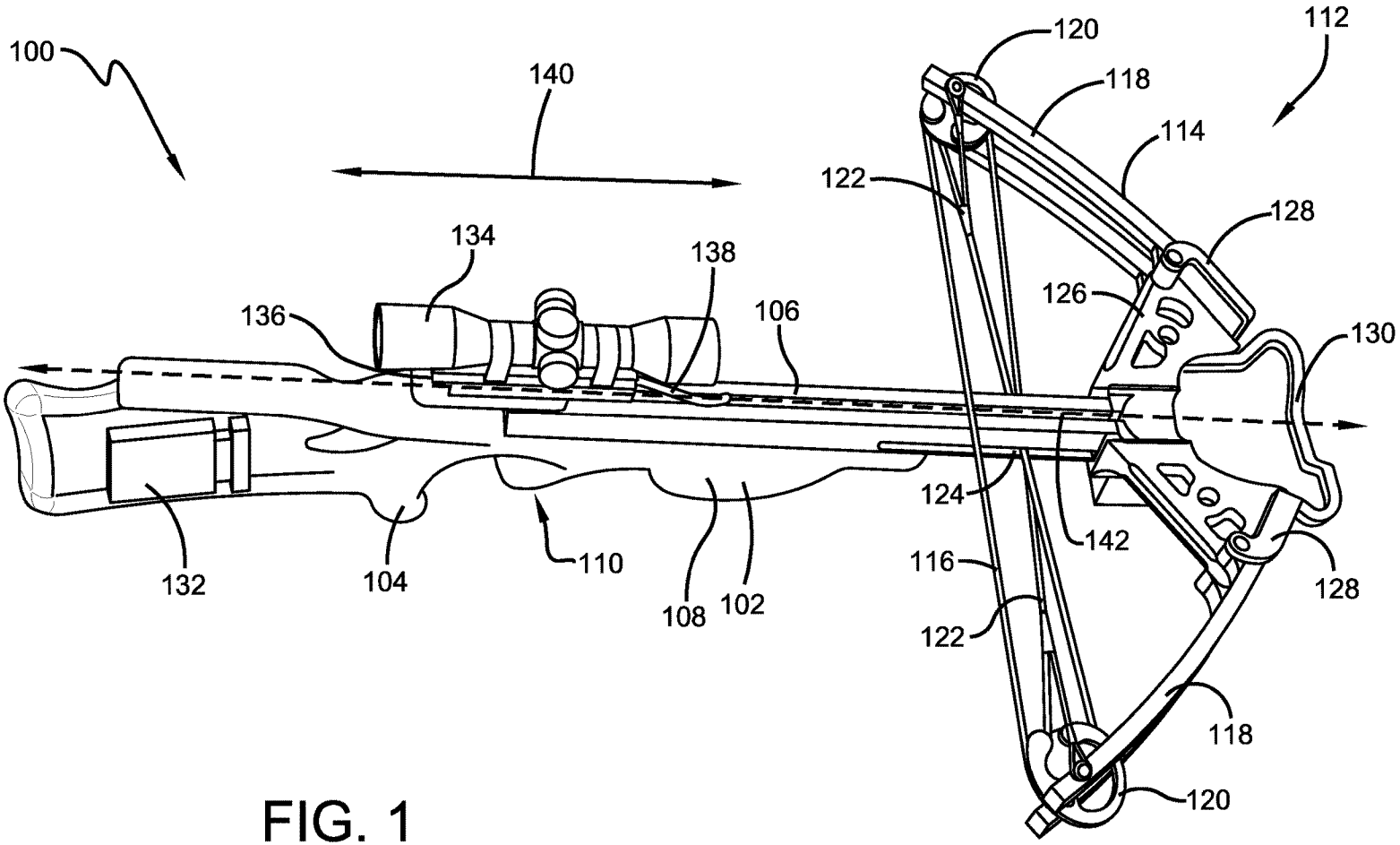
FIG. 1 is a perspective view a crossbow.

Referring now to the drawings wherein the showings are for purposes of illustrating embodiments of the invention only and not for purposes of limiting the same, and wherein like reference numerals are understood to refer to like components, FIG. 1 shows a crossbow 100 that may use a cable saver according to some embodiments of this invention. The crossbow 100 has a main beam 102 including a stock member 104 and a barrel 106. The main beam 102 has a longitudinal axis 142. An optional handgrip 108 may be mounted to the main beam 102 in any conventional manner. A trigger mechanism 110 suitable for shooting an arrow is mounted to the main beam 102 in any suitable manner. It should be noted that the crossbow 100 may comprise any trigger mechanism 110 chosen with sound judgment by a person of ordinary skill in the art. The crossbow 100 also includes a bow assembly 112 adapted to propel an arrow and having a bow 114 and a bowstring 116. The bow 114 includes a pair of bow limbs 118, 118 that receive the bowstring 116 in any conventional manner chosen with the sound judgment of a person of ordinary skill in the art. For the embodiment shown, a pair of cams (which may be also pulleys and/or wheels) 120, 120 mounted to the bow limbs 118, 118 receive the bowstring 116 in a known manner; making the bow a compound bow. While the crossbow shown uses a compound bow, it should be understood that this invention will work well with any type of bow chosen with sound judgment by a person of ordinary skill in the art. One or more strings or cables 122, in addition to the bowstring 116, may extend between opposite sides of the crossbow 100. The strings or cables 122 may, in some embodiments, be interconnected between the wheels 120, 120 and/or bow limbs 118, 118 in any manner chosen with the sound judgment of a person of skill in the art. The one or more cables 122 may pass through and/or near a main beam slot 124 formed in or on the main beam 102. For the embodiment shown, the main beam slot 124 is formed in the barrel 106.

With continuing reference to FIG. 1, numerous other optional crossbow components may be used with a crossbow using a cable saver according to some embodiments of this invention. The crossbow 100 may include, for example, a riser or block 126 having a pair of limb pockets 128, 128 that receive the bow limbs 118, 118, as shown. A stirrup 130 may be attached to the riser 126 and may be used for manually cocking the crossbow 100 in a manner known to those of skill in the art. Optionally, or in addition to the stirrup, a cocking unit 132 may be provided for use in cocking the crossbow 100. Still other optional components may include a scope 134 attached to a scope mount 136 that is supported on the main beam 102. Another optional component shown is an arrow retention spring 138. As the operation of these components is well known to those of skill in the art, no further details will be provided.

Figure 2:
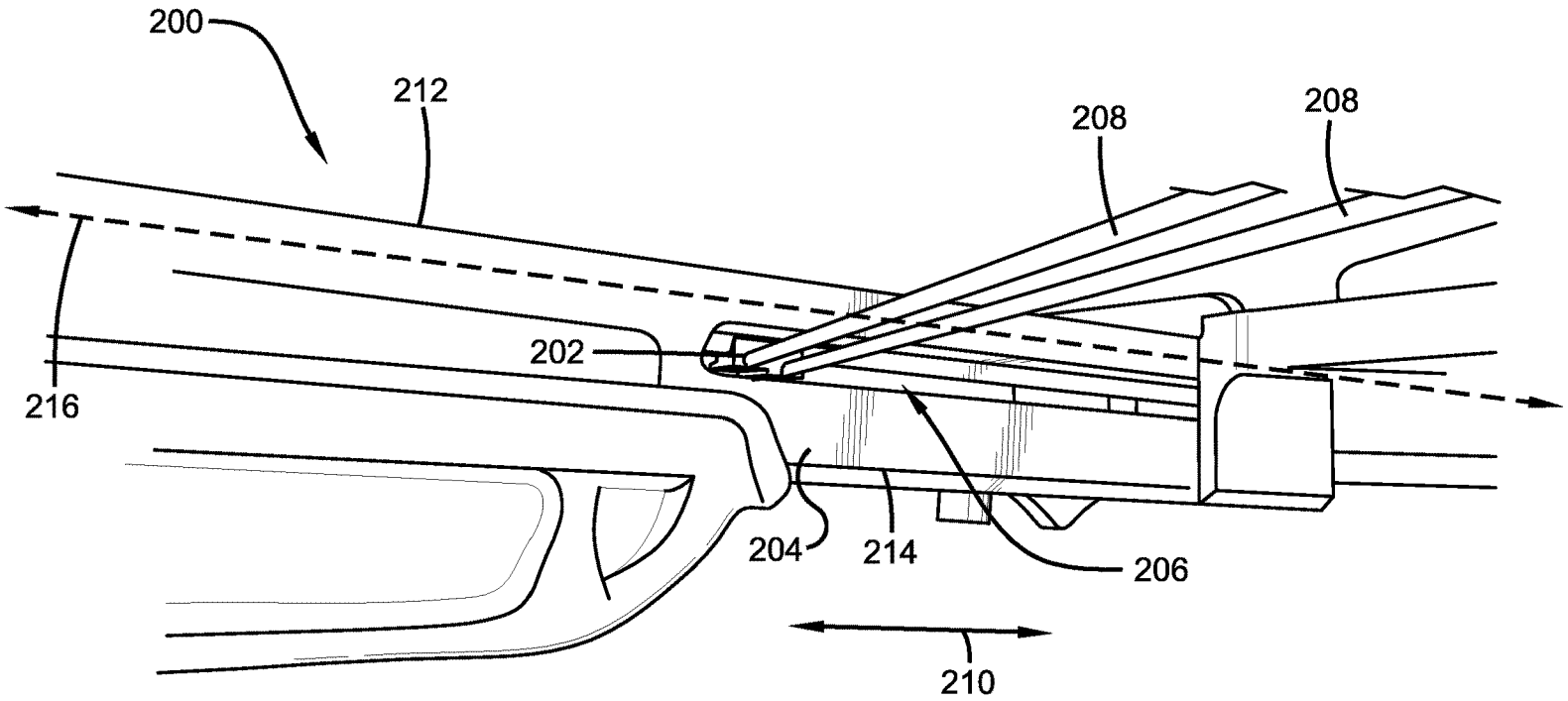
FIG. 2 is a close-up view of a portion of a crossbow.

FIG. 2 shows a close-up view of a crossbow 200 that may use a cable saver 202 according to some embodiments of this invention. The crossbow 200 has a main beam 204 having a longitudinal axis 216 and a main beam slot 206 that engages the cable saver 202. One or more cables 208 (two shown) that extend from one side of the main beam 204 to the other may be engaged with the cable saver 202 and thus also engaged with the main beam slot 206, as shown. The cables 208 and the cable saver 202 may move within the main beam slot 206 in a pivoting motion, as will be described below, when the crossbow 200 is drawn or cocked and when the crossbow 200 is fired or shot. In some embodiments, the cable saver of this invention will pivot only and exclude linear movement. In other embodiments, the cable saver of this invention will pivot and move generally linearly in the directions indicated with arrow 210 when the crossbow 200 is drawn or cocked and when the crossbow 200 is fired or shot. The similar linear motion of the cable saver is shown with arrow 140 in FIG. 1.

Figure 5:
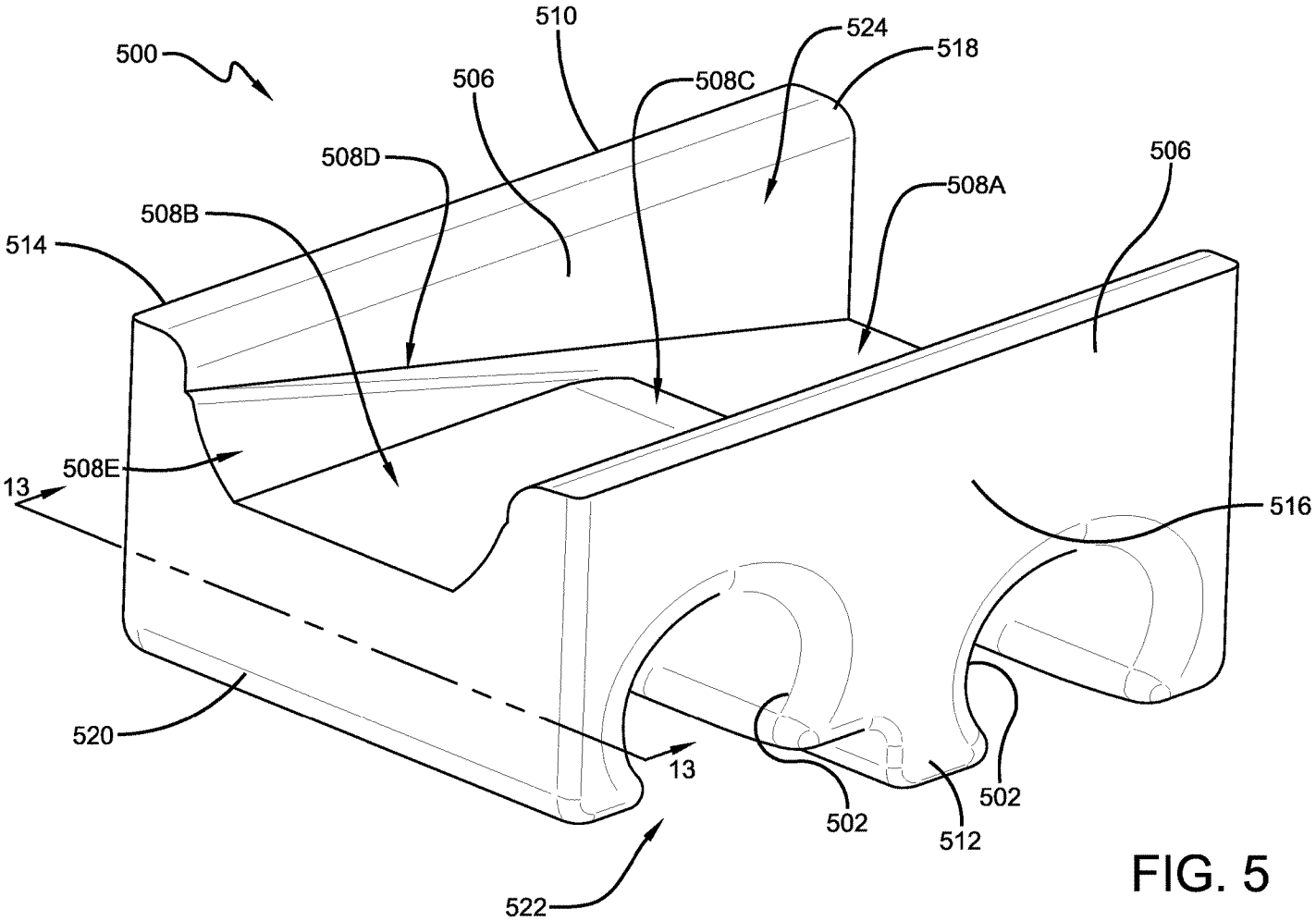
FIG. 5 is an end perspective view of a cable saver according to some embodiments of this invention.

FIGS. 5-14 show a cable saver 500 according to some embodiments of this invention. The cable saver 500 may have, as shown in FIG. 5, a top 510, a bottom 512, a first side 514, a second side 516 opposite the first side, a first end 518, and a second end 520 opposite the first end. The cable saver 500 may have a cable engagement portion 522 designed to engage at least one of the one or more bow cables and a main beam engagement portion 524 designed to engage the crossbow main beam. The main beam engagement portion 524 may engage a barrel rail in some embodiments but the barrel engagement portion 524 may engage any part of a crossbow main beam chosen with the sound judgment of a person of skill in the art. For the embodiment shown, the cable engagement portion 522 is on the bottom 512 of the cable saver 500 and the main beam engagement portion 524 is on the top 510, but the orientation of these portions can be any chosen with the sound judgment of a person of skill in the art.

Figure 6:
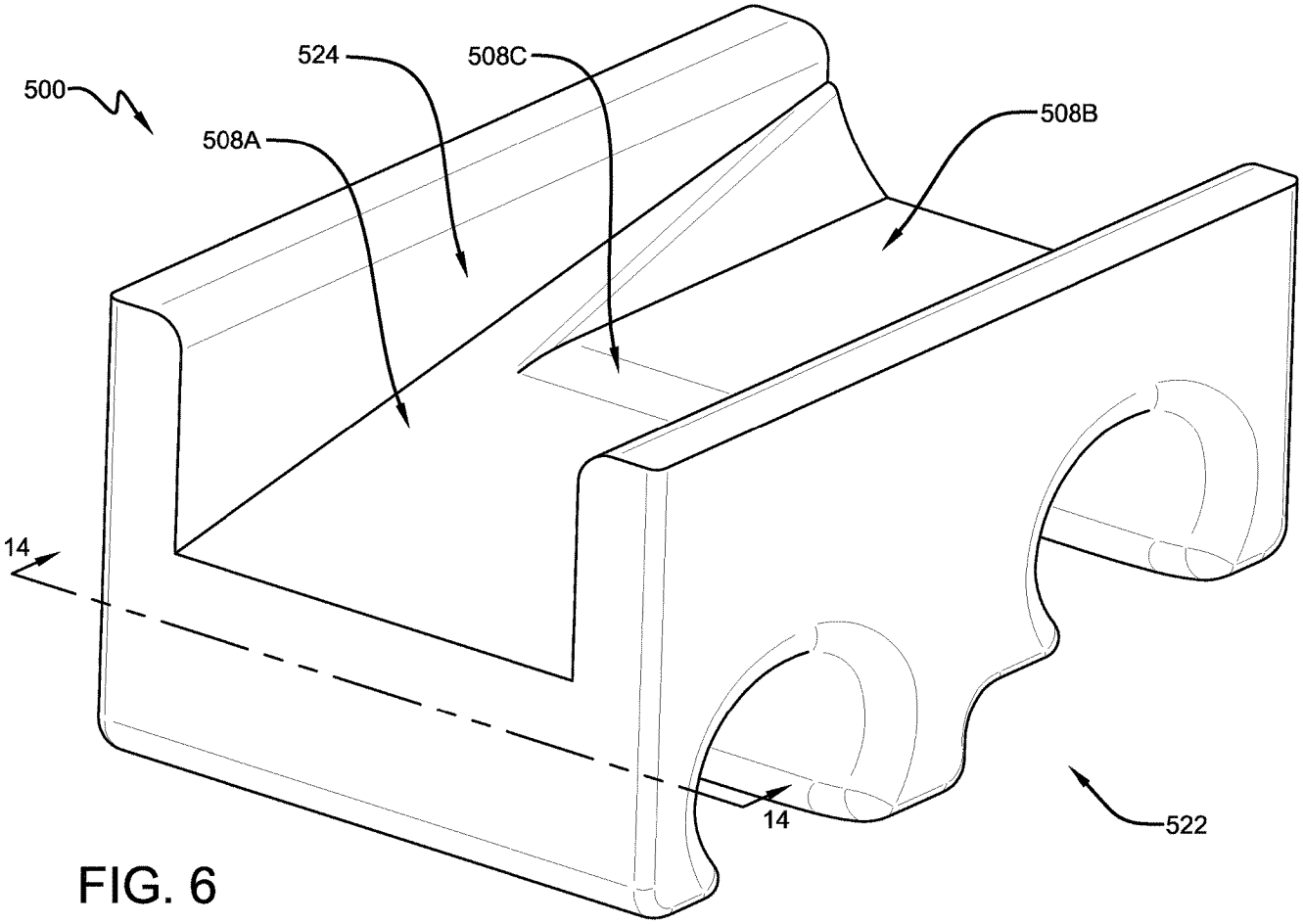
FIG. 6 is an opposite end perspective view of the cable saver shown in FIG. 5.
Figure 7:
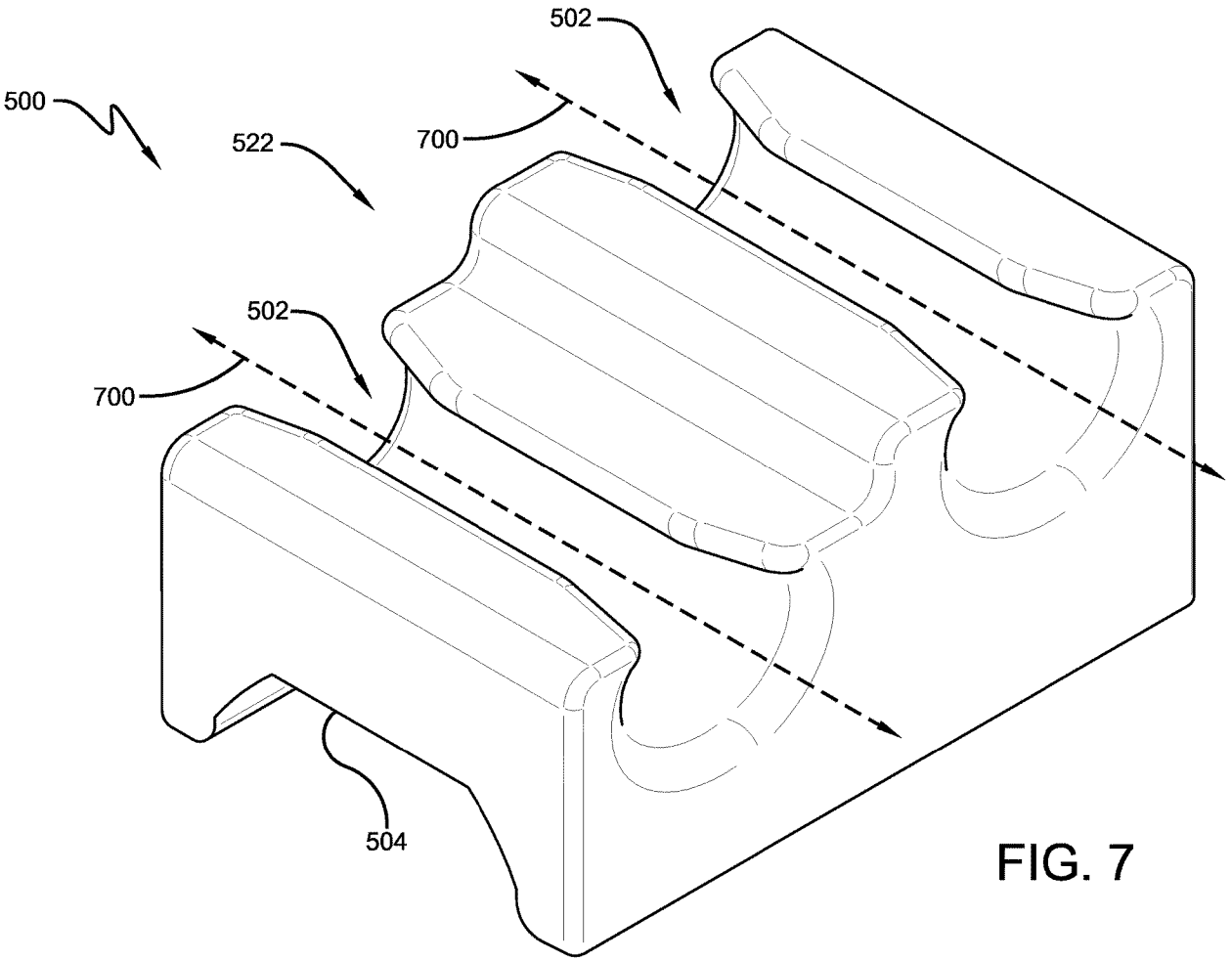
FIG. 7 is a bottom perspective view of the cable saver shown in FIG. 5.
Figure 8:
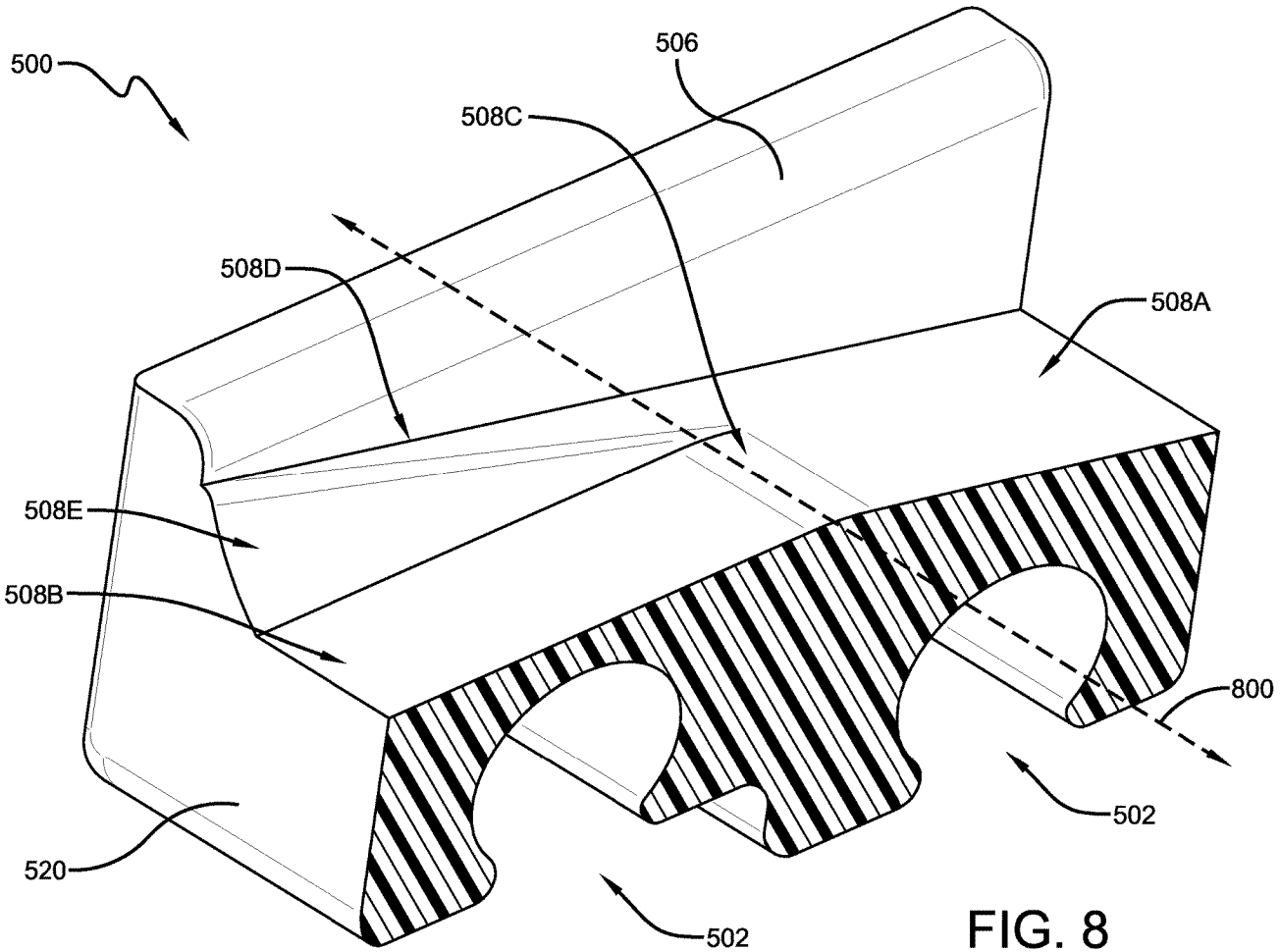
FIG. 8 is a sectional view of the cable saver shown in FIG. 5.
Figure 9:
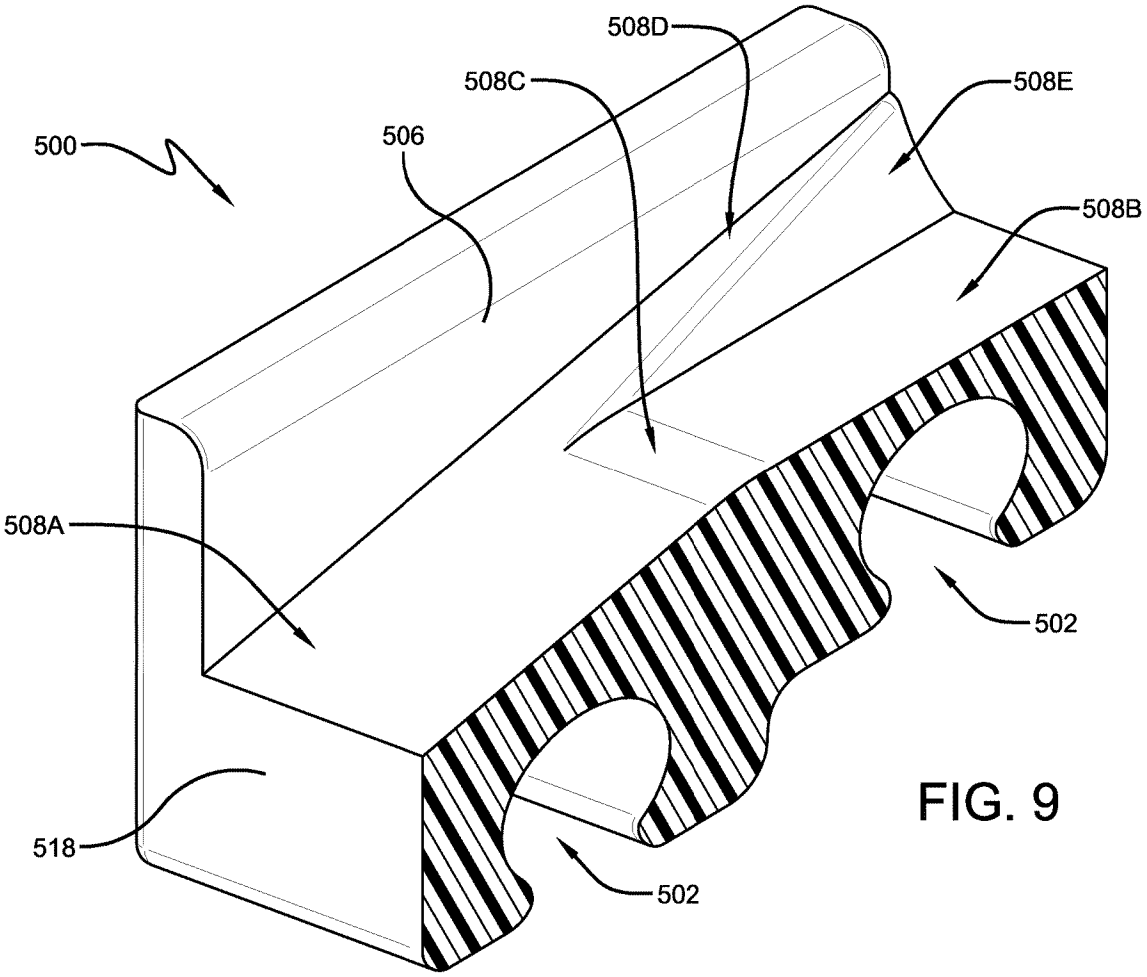
FIG. 9 is a sectional view of the cable saver shown in FIG. 6.
Figure 10:
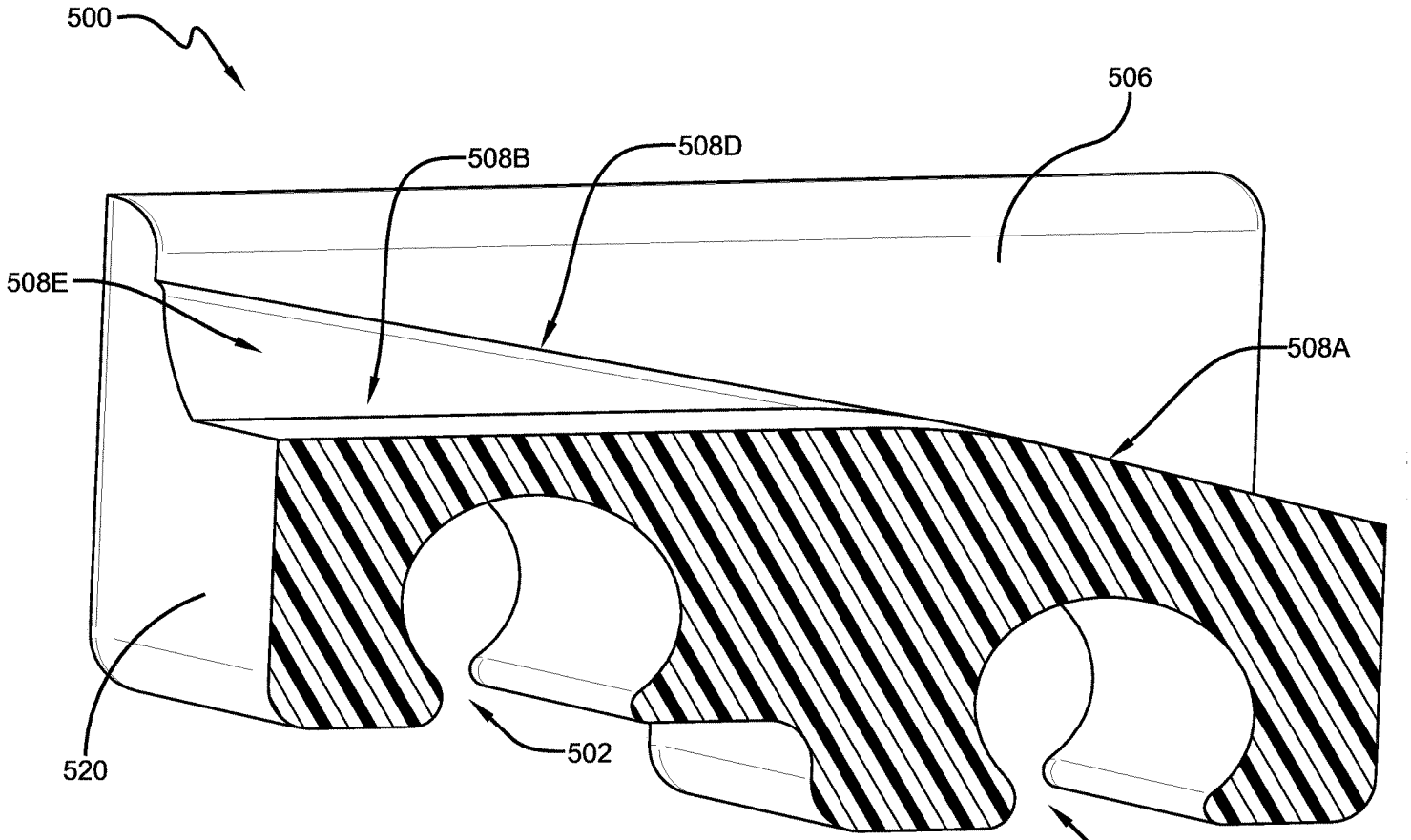
FIG. 10 is view similar to that shown in FIG. 8 but from a different angle.

With reference now to FIGS. 5-7, the cable engagement portion 522 may include one or more cable reception openings 502 that engage crossbow cables. For the embodiment shown, two cable reception openings 502, 502 are used and each one is designed to receive a cable. Each cable reception opening 502 may have a longitudinal axis 700 that extends along the length of the opening 502, as shown in FIG. 7. For the embodiment shown, the longitudinal axes 700, 700 may be substantially parallel to each other. For the embodiment shown, one cable reception openings 502 is on the first end 518 of the cable saver 500 and the other cable reception openings 502 is on the second end 520.

With reference now to FIGS. 5-6 and 8-12, the main beam engagement portion 524 may include a first surface 508A, a second surface 508B, and a pivot surface 508C that is positioned between the first and second surfaces 508A, 508B. For the embodiment shown, the first surface 508A is on the first end 518 of the cable saver 500 and the second surface 508B is on the second end 520. The pivot surface 508C may define a pivot axis 800, as shown in FIGS. 8, 11 and 13-14. For the embodiment shown, the first and second surfaces 508A, 508B are substantially planar and the pivot surface 508C is curved. The curved pivot surface 508C shown is curved convexly with respect to the first and second surfaces 508A, 508B and thus reduces wear. In alternate embodiments, pivot surface 508C is substantially planar. The first, second and pivot surfaces 508A, 508B, 508C may have any shape and orientation chosen with the sound judgment of a person of skill in the art. The main beam engagement portion 524 may include by first and second side walls 506 separated by a floor surface 508. The first, second and pivot surfaces 508A, 508B, 508C may all lie on the floor 508, as shown.

Figure 11:
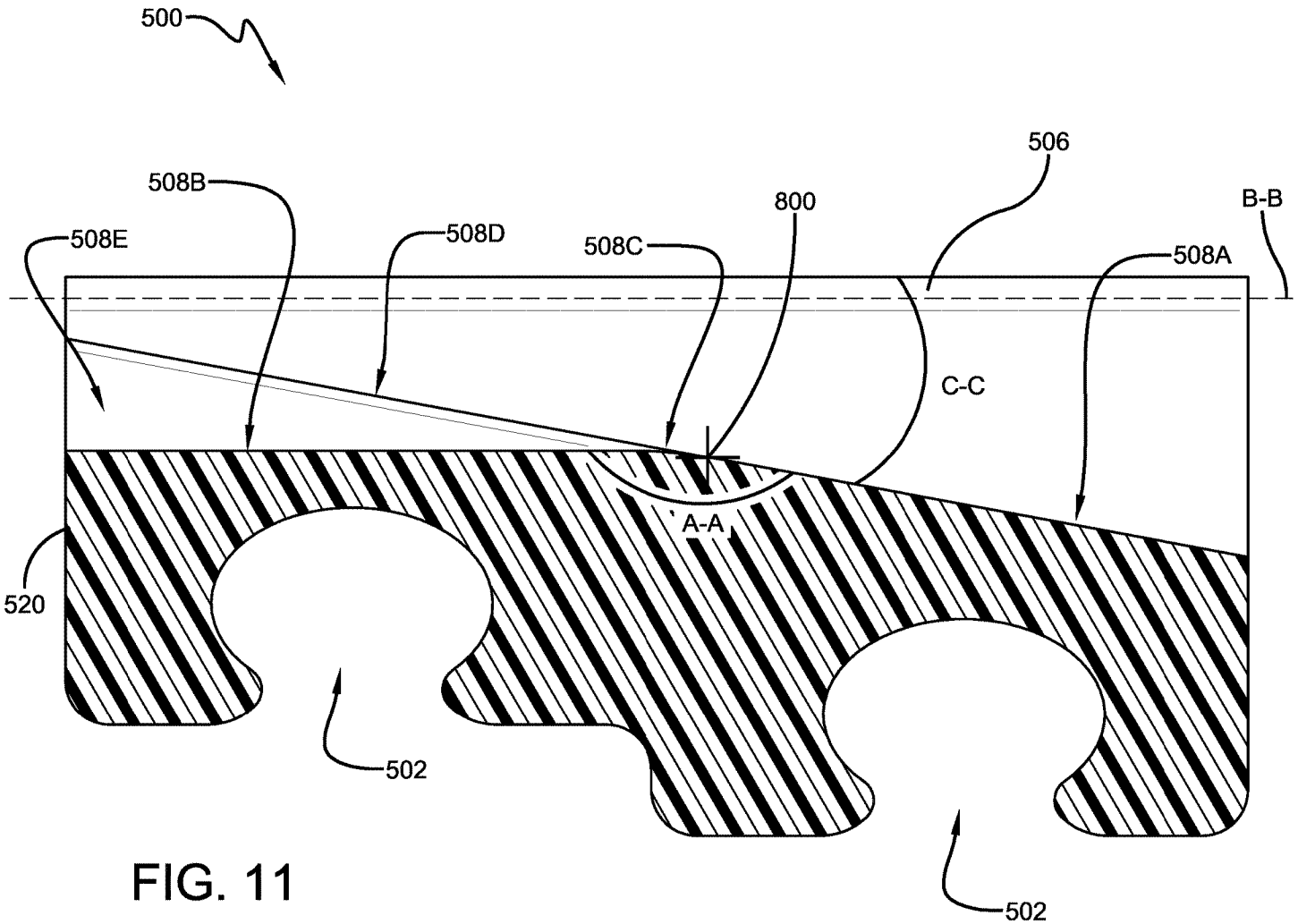
FIG. 11 is a side sectional view of the cable saver shown in FIG. 5.
Figure 12:
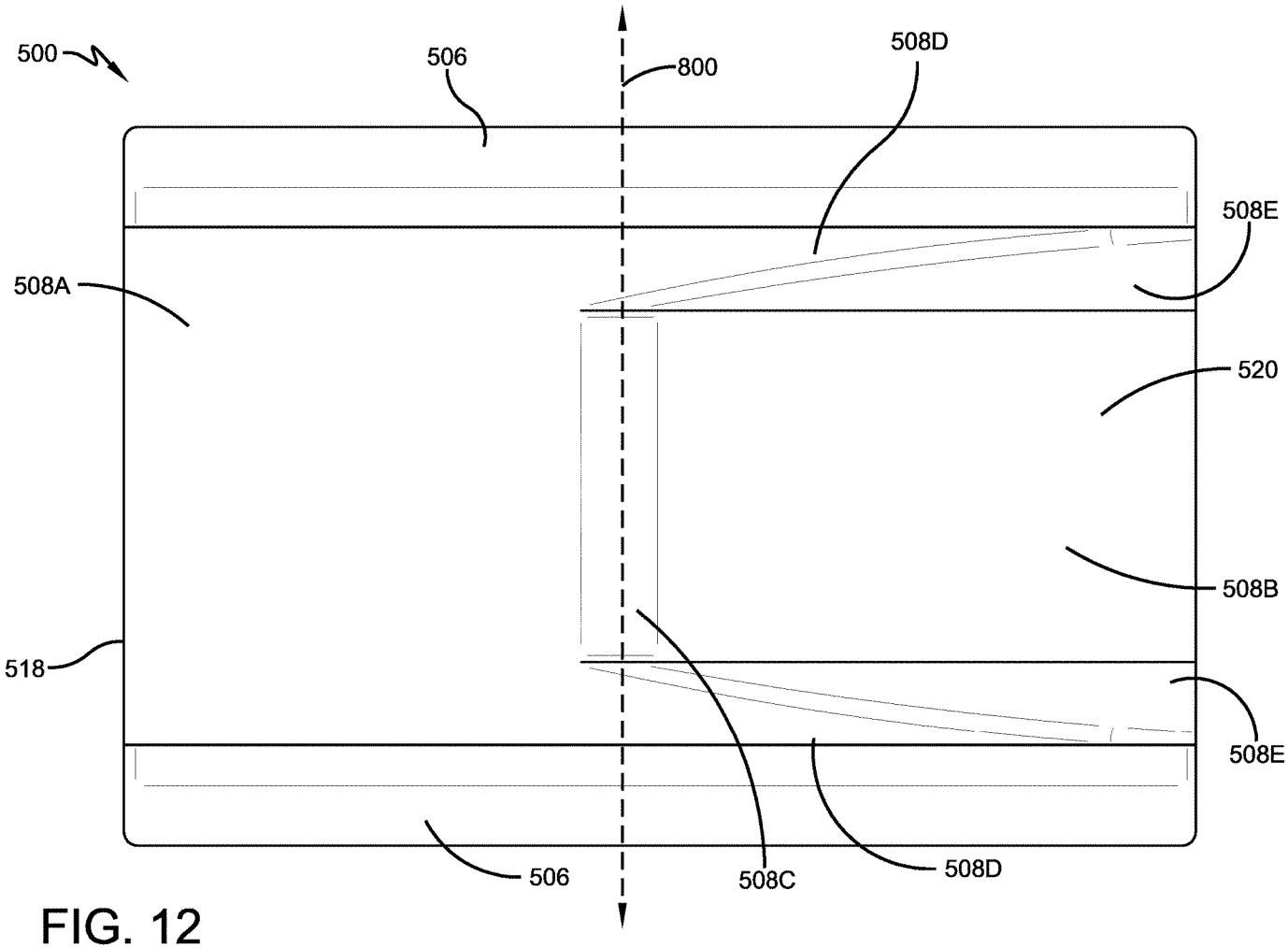
FIG. 12 is a top view of the cable saver shown in FIG. 5.
Figure 14:
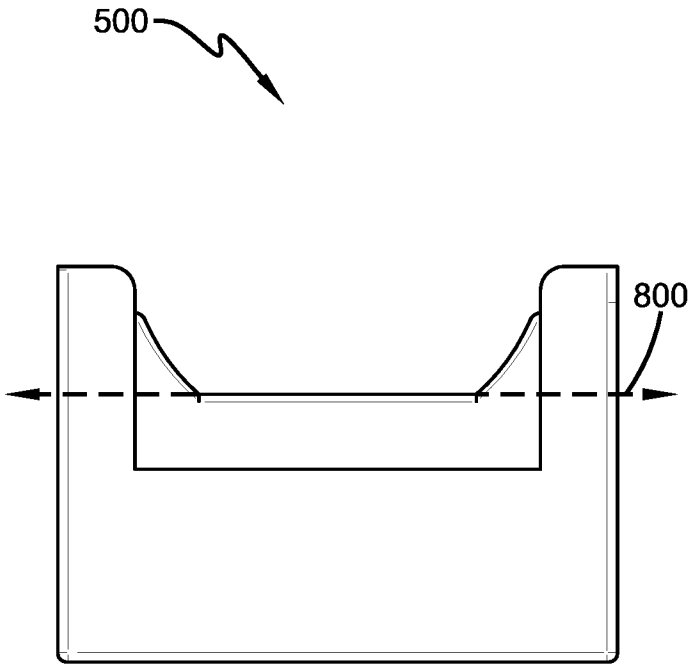
FIG. 14 is an end view of a cable saver taken along the line 14-14 of FIG. 6.
Figure 13:
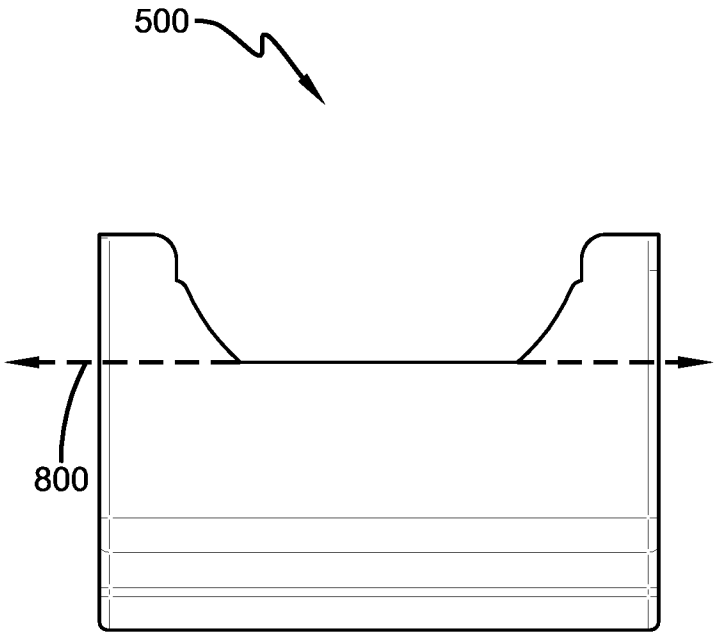
FIG. 13 is an end view of a cable saver taken along the line 13-13 of FIG. 5.

With reference now especially to FIG. 11, surface 508A may be angled at a smallest angle A-A with respect to surface 508B. Angle A-A may be any angle chosen with the sound judgement of a person of skill in the art. In one embodiment, angle A-A is between 90 degrees and 179 degrees. In another embodiment, angle A-A is between 135 degrees and 175 degrees. For the embodiment shown, angle A-A is about 170 degrees.

With reference now to FIG. 11, for the embodiments shown, surface 508B is substantially parallel with a top surface B-B of wall 506 while surface 508A is at an angle C-C with respect to wall top surface B-B. With this non-limiting arrangement, angle A-A plus angle C-C equals 180 degrees. Thus, if angle A-A is about 170 degrees, angle CC is about 10 degrees, as shown. In some embodiments, shown in FIGS. 5-6 and 8-12, positioned between surface 508B and the side walls 506, on each side, are surfaces 508D and 508E. Surfaces 508D, 508D may be substantially planar and on the same plane as (coplanar with) surface 508A. Surfaces 508D may narrow from surface 508C to the second end 520 of the cable saver 500, as shown. Surfaces 508E may interconnect surfaces 508D with surface 508B. Surfaces 508E may be curved surfaces, as shown. Surfaces 508E, 508E may be sized and shaped so that they are contoured to match the shape of the main beam that they engage. As one non-limiting example, note that main beam rail 310 in FIG. 3 has a specific size and shape. The surfaces 508E, 508E of cable saver 500 may be sized and shaped, in one non-limiting embodiment, so that they are contoured to match main beam rail 310. Surfaces 508D, 508D, 508E, 508E may also be positioned on the second end 520 of the cable saver 500, as shown. This creates a secure engagement between the cable saver 500 and the main beam as will be discussed below.

With reference now especially to FIGS. 11-12 and 15-16, operation of the cable saver 500 will now described. When the cable saver 500 is properly positioned within the main beam slot, because surface 508A is angled with respect to surface 508B, cable saver 500 pivots about the pivot surface 508C pivot axis 800. This pivoting motion may replace all or some of the sliding motion in the directions shown with arrow 140 in FIG. 1 and arrow 210 in FIG. 2. This pivoting motion greatly reduces the problems in the prior art described above. More specifically, in some embodiments, the cable saver 500 pivots about the pivot axis 800 with respect to the main beam between: 1) a first position, illustrated in FIG. 15, where the first surface 508A contacts the main beam and the second surface 508B does not contact the main beam; and 2) a second position, illustrated in FIG. 16, where the second surface 508B contacts the main beam and the first surface 508A does not contact the main beam. While the cable saver 500 may pivot with respect to the main beam as a result of numerous forces, a common cause will be a force exerted on the cable saver by the at least one of the one or more cables.

With reference now to FIGS. 5-7, 11-12 and 15-16, as the cable saver 500 pivots, the pivot axis 800 may be substantially perpendicular to the main beam longitudinal axis 1500 when the cable saver 500 is properly positioned within the main beam slot (as shown, for example, in FIG. 2). As the cable saver 500 pivots, the pivot axis 800 may be substantially perpendicular to the longitudinal axis(es) 700 of the cable reception opening(s) 502 when the cable saver 500 is properly positioned within the main beam slot. Thus, in some embodiments, when the cable saver 500 is properly positioned within the main beam slot, the pivot axis 800 may be substantially parallel with the longitudinal axis(es) 700.

With reference to FIGS. 11-12 and 15-16, as the cable saver 500 pivots, the degrees of pivot will depend on the angle A-A between surfaces 508A and 508B shown in FIG. 11 and discussed above. In one embodiment, the cable saver 500 will pivot with respect to the main beam between 1 and 90 degrees between the position shown in FIG. 15 and the position shown in FIG. 16. In another embodiment, the cable saver 500 will pivot with respect to the main beam between 5 and 45 degrees between the position shown in FIG. 15 and the position shown in FIG. 16. In another embodiment, the cable saver 500 will pivot with respect to the main beam at least 5 degrees between the position shown in FIG. 15 and the position shown in FIG. 16. For the embodiment shown, the cable saver 500 will pivot with respect to the main beam about 10 degrees between the position shown in FIG. 15 and the position shown in FIG. 16.

With reference now to FIGS. 5-7, 11-12 and 15-16, in embodiments where the cable saver 500 includes surfaces 508D, 508D, that are coplanar with surface 508A, said surfaces 508D, 508D will contact the main beam when surface 508A contacts the main beam and will not contact the main beam when surface 508A does not contact the main beam. This increases the total cable saver surface area (surfaces 508A, 508D and 508D combined) that contacts the main beam when the cable saver 500 is in the position illustrated in FIG. 15 minimizing main beam/cable saver pressure on the cable saver 500. In embodiments where the cable saver 500 includes surfaces 508E, 508E and is contoured to match the shape of the main beam that they engage, said surfaces 508E, 508E will contact the main beam when surface 508B contacts the main beam and will not contact the main beam when surface 508B does not contact the main beam. This increases the total cable saver surface area (surfaces 508B, 508E and 508E combined) that contacts the main beam when the cable saver 500 is in the position illustrated in FIG. 16 minimizing main beam/cable saver pressure on the cable saver 500.

Figure 15:
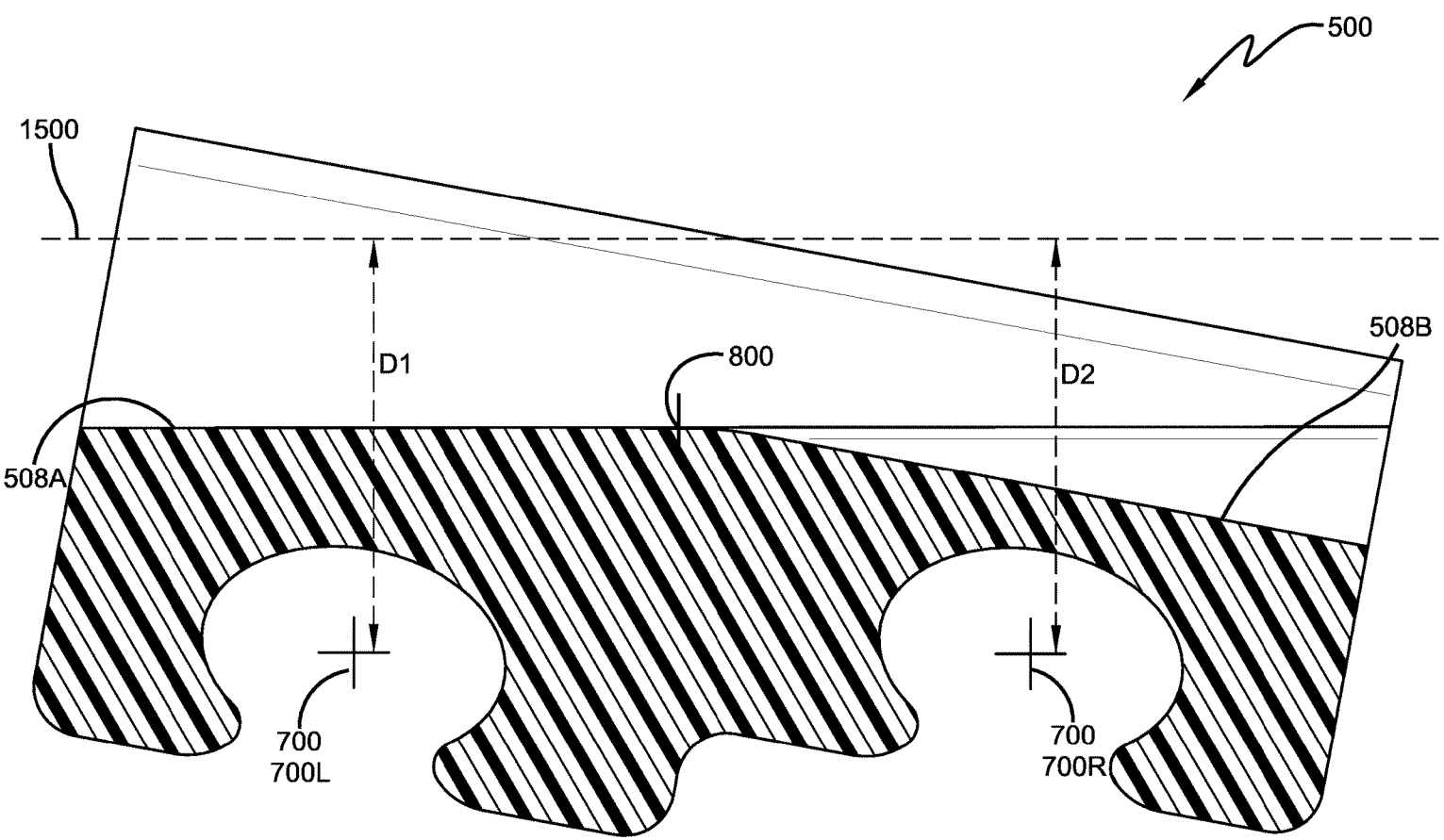
FIG. 15 is a side sectional view of the cable saver shown in FIG. 5 illustrating a first relative pivot position with respect to a crossbow main beam.
Figure 16:
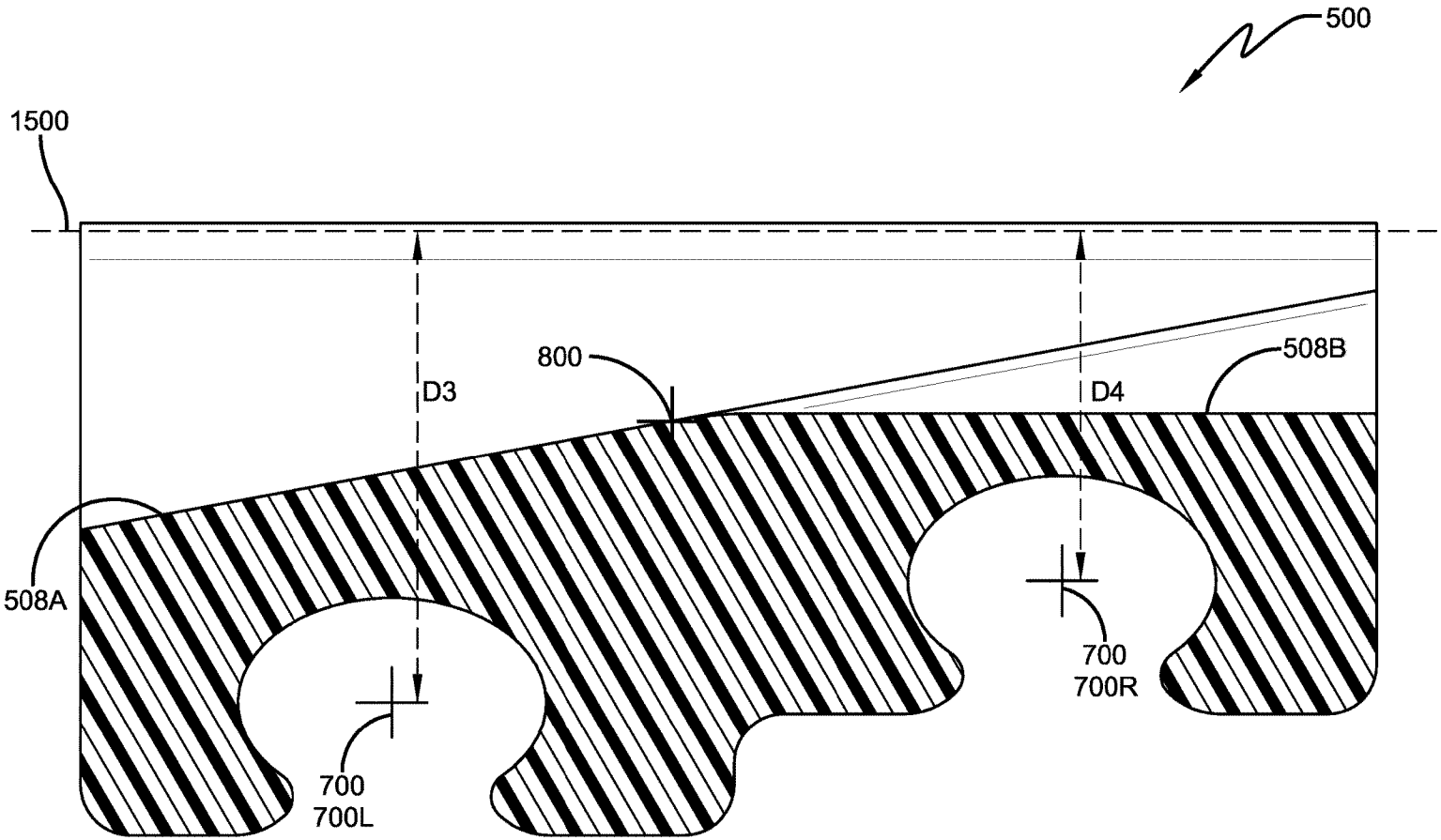
FIG. 16 is a view similar to that shown in FIG. 15 except illustrating a second relative pivot position with respect to a crossbow main beam.

With continuing reference to FIGS. 5-7, 11-12 and 15-16, in embodiments where the cable saver 500 includes the two cable reception openings 502, 502 shown, the effect of the cable saver 500 pivoting motion can be detected based on relative distances between the longitudinal axes 700, 700 of the cable reception openings 502, 502 and the main beam longitudinal axis 1500. As is well known to those of skill in the art, the shortest distance between two perpendicular lines that do not intersect is the length of a third line that is simultaneously perpendicular to both other lines. With reference now to FIG. 15, distance D1 is the shortest distance between longitudinal axis 700 on the left hand side (also referenced 700L) and main beam longitudinal axis 1500. Similarly, distance D2 is the shortest distance between longitudinal axis 700 on the right hand side (also referenced 700R) and main beam longitudinal axis 1500. With reference now to FIG. 16, distance D3 is the shortest distance between longitudinal axis 700 on the left hand side (also referenced 700L) and main beam longitudinal axis 1500 and distance D4 is the shortest distance between longitudinal axis 700 on the right hand side (also referenced 700R) and main beam longitudinal axis 1500. As the cable saver 500 pivots, one of the shortest distances increases while the other simultaneously decreases. For the embodiment shown, the shortest distance between longitudinal axis 700L and the main beam longitudinal axis 1500 increases as the cable saver 500 pivots from the position shown in FIG. 15 to the position shown in FIG. 16 (that is, distance D3 is greater than distance D1) while simultaneously the shortest distance between longitudinal axis 700R and the main beam longitudinal axis 1500 decreases (that is, distance D4 is less than distance D2). The specific dimensions of these distances can be any chosen by the sound judgement of a person of skill in the art.

It should be understood that the cable saver according this invention may be used with any crossbow chosen with the sound judgement of a person of skill in the art.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved.

In the patent claims that follow, it should be understood that any component referred to as being "associated" is not being claimed positively but rather indicates the environment in which the claimed invention is used. Thus, for a non-limiting example, if a patent claim includes a "crossbow cable saver for use with an associated crossbow" then Applicant's intent is that infringement does not require a crossbow. Rather, infringement only requires a cable saver that is capable of being used with a crossbow.

I claim:

1. A crossbow cable saver for use with an associated crossbow having: 1) a bow including: (a) a bowstring; and, (b) one or more cables; and, 2) a main beam having a main beam slot; the crossbow cable saver comprising:

a cable engagement portion designed to engage at least one of the one or more cables; and, a main beam engagement portion designed to engage the main beam and comprising: a first surface, a second surface, and a pivot surface that is positioned between the first and second surfaces and that defines a pivot axis;

wherein the cable saver is operable, when properly positioned within the main beam slot, to pivot about the pivot axis with respect to the main beam between: 1) a first position where the first surface contacts the main beam and the second surface does not contact the main beam; and 2) a second position where the second surface contacts the main beam and the first surface does not contact the main beam.

2. The crossbow cable saver of claim 1 wherein:

the first surface is substantially planar;

the second surface is substantially planar; and the first surface is angled at a smallest angle with respect to the second surface at an angle A-A that is between 90 degrees and 179 degrees.

3. The crossbow cable saver of claim 2 wherein angle A-A is between 135 degrees and 175 degrees.

4. The crossbow cable saver of claim 1 wherein:

the main beam has a longitudinal axis; and the pivot axis is substantially perpendicular to the longitudinal axis when the cable saver is properly positioned within the main beam slot.

5. The crossbow cable saver of claim 1 wherein:

the main beam engagement portion comprises first and second side walls separated by a floor; and the first, second and pivot surfaces all lie on the floor.

6. The crossbow cable saver of claim 1 wherein:

the cable saver comprises a top, a bottom, a first end, and a second end;

the main beam engagement portion is on the top;

the cable engagement portion is on the bottom;

the first surface is on the first end;

the second surface is on the second end; and the main beam engagement portion on the second end is contoured to match the shape of the main beam.

7. The crossbow cable saver of claim 1 wherein:

the cable saver comprises a top, a bottom, a first end, and a second end;

the main beam engagement portion is on the top;

the cable engagement portion is on the bottom;

the first surface is on the first end;

the second surface is on the second end;

a third surface is on the second end and is coplanar with the first surface; and the third surface contacts the main beam when the first surface contacts the main beam.

8. The crossbow cable saver of claim 7 wherein:

the cable saver comprises a first side and a second side;

a fourth surface is on the second end and is coplanar with the first surface;

the fourth surface contacts the main beam when the first surface contacts the main beam; and the second surface is positioned side to side between the third and fourth surfaces.

9. The crossbow cable saver of claim 1 wherein:

the first surface is substantially planar;

the second surface is substantially planar; and the pivot surface is curved.

10. A method for a crossbow cable saver used with an associated crossbow having: 1) a bow including: (a) a bowstring; and, (b) one or more cables; and, 2) a main beam having a main beam slot; the method comprising the steps of:

(A) providing a crossbow cable saver comprising:

a cable engagement portion designed to engage at least one of the one or more cables; and, a main beam engagement portion designed to engage the main beam and comprising: a first surface, a second surface, and a pivot surface that is positioned between the first and second surfaces and that defines a pivot axis; and (B) providing the cable saver to be operable, when properly positioned within the main beam slot, to pivot about the pivot axis with respect to the main beam between: 1) a first position where the first surface contacts the main beam and the second surface does not contact the main beam; and 2) a second position where the second surface contacts the main beam and the first surface does not contact the main beam.

11. The method of claim 10 wherein step (B) comprises the step of:

providing the cable saver to be operable to pivot with respect to the main beam between 1 and 90 degrees between the first position and the second position.

12. The method of claim 10 wherein step (B) comprises the step of:

providing the cable saver to be operable to pivot with respect to the main beam between 5 and 45 degrees between the first position and the second position.

13. The method of claim 10 wherein the main beam has a longitudinal axis and step (B) comprises the step of:

providing the cable saver to be operable, when properly positioned within the main beam slot, to pivot with the pivot axis substantially perpendicular to the longitudinal axis.

14. The method of claim 10 wherein step (B) comprises the step of:

providing the cable saver to be operable, when properly positioned within the main beam slot, to pivot with respect to the main beam in response to a force exerted on the cable saver by the at least one of the one or more cables.

15. A crossbow cable saver for use with an associated crossbow having: 1) a bow including: (a) a bowstring; and, (b) one or more cables; and, 2) a main beam having a main beam slot; the crossbow cable saver comprising:

a cable engagement portion designed to engage at least one of the one or more cables; and, a main beam engagement portion designed to engage the main beam and comprising: a pivot surface that that defines a pivot axis;

wherein the cable saver is operable, when properly positioned within the main beam slot, to pivot about the pivot axis at least 5 degrees with respect to the main beam in response to a force exerted on the cable saver by the at least one of the one or more cables.

16. The crossbow cable saver of claim 15 wherein:

the associated main beam has a longitudinal axis; and the pivot axis is substantially perpendicular to the longitudinal axis when the cable saver is properly positioned within the main beam slot.

17. The crossbow cable saver of claim 15 wherein:

the associated main beam has a longitudinal axis;

the associated bow has two or more cables;

the cable engagement portion comprises a first cable reception opening that receives a first of the two or more cables and a second cable reception opening that receives a second of the two or more cables;

the first cable reception opening has a first opening longitudinal axis that is substantially perpendicular to the main beam longitudinal axis when the cable saver is properly positioned within the main beam slot;

the second cable reception opening has a second opening longitudinal axis that is substantially parallel to the first opening longitudinal axis and substantially perpendicular to the main beam longitudinal axis when the cable saver is properly positioned within the main beam slot;

a first distance is the shortest distance between the first opening longitudinal axis and the main beam longitudinal axis;

a second distance is the shortest distance between the second opening longitudinal axis and the main beam longitudinal axis; and one of the first and second distances increases while the other of the first and second distances simultaneously decreases when the cable saver pivots about the pivot axis.

18. The crossbow cable saver of claim 15 wherein:

the main beam engagement portion comprises first and second side walls separated by a floor; and the pivot surface lies on the floor.

19. The crossbow cable saver of claim 15 wherein:

the associated bow has two or more cables;

the cable engagement portion comprises a first cable reception opening that receives a first of the two or more cables and a second cable reception opening that receives a second of the two or more cables;

the cable saver comprises a top, a bottom, a first end, and a second end;

the main beam engagement portion is on the top;

the cable engagement portion is on the bottom;

the first cable reception opening is on the first end; and the second cable reception opening is on the second end.

20. The crossbow cable saver of claim 15 wherein the pivot surface is curved.

* * * * *